United States Patent [19]

Hosono et al.

[11] 4,365,586

[45] Dec. 28, 1982

[54] DEVELOPING DEVICE

[75] Inventors: Nagao Hosono, Chofu; Nobuyuki Miyake, Yokohama; Junichiro Kanbe, Tokyo; Shusei Tsukada; Kozo Arao, both of Yokohama, all of Japan

[73] Assignee: Canon Kabushiki Kaisha, Tokyo, Japan

[21] Appl. No.: 118,926

[22] Filed: Feb. 6, 1980

[30] Foreign Application Priority Data

Feb. 15, 1979 [JP] Japan ..... 54-17738
Feb. 15, 1979 [JP] Japan ..... 54-17740

[51] Int. Cl.[3] ..... G03G 15/09

[52] U.S. Cl. ..... 118/652; 118/657; 118/658; 355/3 DD

[58] Field of Search ..... 118/652, 653, 657, 658, 118/689, 690, 691; 355/3 DD; 430/125

[56] References Cited

U.S. PATENT DOCUMENTS 2,839,400 6/1958 Moncrieff-Yeates ..... 430/103
3,232,190 2/1966 Willmott ..... 355/3 R
4,089,297 5/1978 Morita et al. ..... 355/3 DD X
4,100,884 7/1978 Mochizuki et al. ..... 118/658 X
4,126,100 11/1978 Nishihama et al. ..... 118/658
4,226,524 10/1980 Hashimoto ..... 118/657 X

*Primary Examiner*—Evan K. Lawrence
*Attorney, Agent, or Firm*—Fitzpatrick, Cella, Harper & Scinto

[57] ABSTRACT

A developing device for imparting triboelectrically charged developer to a surface to be developed includes a developer holding member disposed with a minute gap with respect to a latent image bearing member for holding and moving developer to a development station, a developer supply for supplying developer to the surface of the developer holding member, and a developer removing blade in contact with the developer holding member for removing the developer used for the development and remaining on the developer holding member, the blade having developer passage openings adjacent the portion which contacts the developer holding member to again impart removed developer to the developer holding means at a position downstream of the development station with respect to the movement of the developer and which is before the supply of developer is terminated at the developer supply.

15 Claims, 10 Drawing Figures

DEVELOPING DEVICE

BACKGROUND OF THE INVENTION

1. Field of the Invention

This invention generally relates to a developing device. More particularly, it relates to a developing device in which a uniform thin layer of one-component developer is formed on developer holding means and this layer is opposed to a latent image bearing member to develop the same.

2. Description of the Prior Art

For the developing devices using one-component developer, various methods are known or have been proposed.

Among these, the jumping developing method is known as a unique method. This method comprises applying developer as a thin layer onto developer holding means, thereafter opposing an electrostatic latent image surface to the surface of the thin layer of developer with a small gap interposed therebetween, and then causing the developer to jump from the developer holding means to the electrostatic latent image surface by the electrostatic attraction thereof to thereby effect development (see U.S. Pat. Nos. 2,839,400 and 3,232,190). According to this method, the developer is not only not attracted to the non-image bearing portion having no latent image potential but also does not contact the non-image bearing portion and therefore, good development free of fog can be accomplished. Further, where use is made of one-component developer using no carrier particle, there are also obtained good effects that the mixture ratio of the developer does not fluctuate and that there is no deterioration of carrier particles.

Also, the Applicant has proposed, as developing methods different from this jumping development method, entirely novel developing methods as disclosed in U.S. Patent Application Ser. Nos. 938,494; 938,101; 058,434 and 058,435.

The former two developing methods comprise disposing one-component magnetic developer, developer holding means (non magnetic) and magnetic field generating means in the named order, forming a uniform thin layer of developer on the developer holding means by the magnetic force of the magnetic field generating means, and opposing the surface of the thin layer of developer to the electrostatic latent image forming surface with a minute gap interposed therebetween so that the former surface does not contact the latter surface. The developer opposed to the image bearing portion is extended by the electrostatic attraction thereof to effect development. These methods can also obtain developed images free of fog because development is effected without the developer contacting the non-image bearing portion.

The latter two methods comprise disposing one-component magnetic developer, developer holding means (non-magnetic) and magnetic field generating means in the named order, forming a uniform thin layer of developer on the developer holding means by the magnetic force of the magnetic field generating means, and opposing the surface of the thin layer of developer to the electrostatic latent image forming surface with a minute gap interposed therebetween so that the former surface does not contact the latter surface. As a developing bias voltage, an AC bias voltage is applied to the same and further, the gap between the electrostatic latent image surface and the developer holding means is varied with time to thereby effect development. By these latter methods, in the initial stage of the development, the developer is caused to arrive at the non-image bearing portion of the electrostatic latent image as well to thereby effect the development of the half-tone portion and the developer is caused to arrive only at the image bearing portion with time to thereby effect the development of such portion. By this, there is obtained the effect of development which is excellent in half-tone reproducibility as compared with the former methods and moreover is free of fog.

According to such developing methods in which development is effected with the thin layer of one-component developer disposed in opposed relationship with the latent image surface, there are obtained very excellent effects in respect of developing performance, image reproducibility, life of developer, etc. as compared with the conventional methods. However, even these developing methods may in some cases encounter the following problems when actually put into practice.

(1) By the developing action, the history of development is left on the layer of developer on the developer holding means to cause a ghost image to be developed during the next cycle of development.

In the aforementioned developing methods, the developer layer formed on the developer holding means is a very thin layer. Therefore, once this developer layer is used for development, a great difference in thickness of the developer layer is created between the portion thereof corresponding to the image bearing portion and the portion thereof corresponding to the non-image bearing portion. Such thickness history of the developer layer is intactly left even if fresh developer is supplied after the developer layer has been used for development, to greatly affect the next cycle of development and cause a disadvantage that the so-called ghost which is a negative pattern of the previously developed image is created in the next cycle of development. This is considered to be attributable to the inability to sufficiently replenish the surface of the developer holding means from which the developer has been brought away with fresh developer in the developer supplying step thereafter (or to some difference in characteristic (especially, tribo property) between the developer remaining on the surface of the developer holding means and the developer newly supplied thereto).

(2) A thin layer of developer is formed on the surface of the developer holding means in a long time during which the developing action is carried out, to reduce the developing performance.

During the developing action, the developer always repeates contact with and separation from the surface of the developer holding means, so that the surface of the developer holding means is contaminated by the developer and a film layer of developer is liable to form thereon. This film layer consists of resin component of low molecular weight contained in the developer, or a control agent for providing the tribo property, or a layer of very minute powder which does not contribute to the development. In any case, if these components cover the surface of the developer holding means, the amount of charge of the developer becomes deficient particularly in the case of the developing methods utilizing the charge created by the friction between the developer and the developer holding means, thus reducing the developing density and/or aggravating the image reproducibility.

(3) In a long time during which the developing action is carried out, aggregation of the developer is created or the adhesive force between the developer and the surface of the developer holding means is enhanced to make difficult the formation of a layer having a unform thickness and cause irregularity of development.

There is no problem when the developer applied onto the developer holding means contributes to development and separates from the surface of the developer holding means within a short time, but if developer which does not contribute to development because of its low developing density is left on the surface of the developer holding means for a long time, the aggregation force of the developer is enhanced or the adhesive force between the developer and the surface of the developer holding means is enhanced to form a partially thick layer of developer which may create irregularity of the developed image.

A developing device having a member for removing toner greater in thickness than at least the toner layer brought away to the electrostatic latent image provided within a toner supply hopper in order to remove the history of development and prevent the creation of the so-called ghost image is disclosed, for example, in U.S. Pat. No. 4,100,884.

However, the device disclosed in this U.S. Patent is not of the type in which all the developer on the surface of the developer holding means is once removed as far as possible and then fresh developer is supplied to the developer holding means to effect development and therefore, it still suffers from the problems as mentioned under items (2) and (3) above, especially the problem (2).

SUMMARY OF THE INVENTION

It is an object of the present invention to provide a novel developing device which solves all the above-noted problems and which is good in image reproducibility and ensures high fidelity of reproduction and permits a long service life of developer.

It is another object of the present invention to eliminate the disadvantage peculiar to the prior art that in a long time during which the developing action is carried out, a thin layer of developer is formed on the surface of the developer holding means to reduce the developing performance.

The present invention solves all the above-mentioned problems by providing a developing device comprising developer holding means for holding and moving developer to a development station, the holding means being spaced from a latent image bearing member by a gap, supply means for supplying developer and a developer removing blade in contact with the holding means and formed with passage openings adjacent to the contact portion of the blade for again imparting the removed developer to the holding means. The removing blade is positioned downstream of the development station with respect to the movement direction of the developer and before the supply of developer is terminated at the supply means.

Other objects and features of the present invention will become apparent from the following detailed description of the invention taken in conjunction with the accompanying drawings.

DESCRIPTION OF THE PREFERRED EMBODIMENTS

Figure 1A:
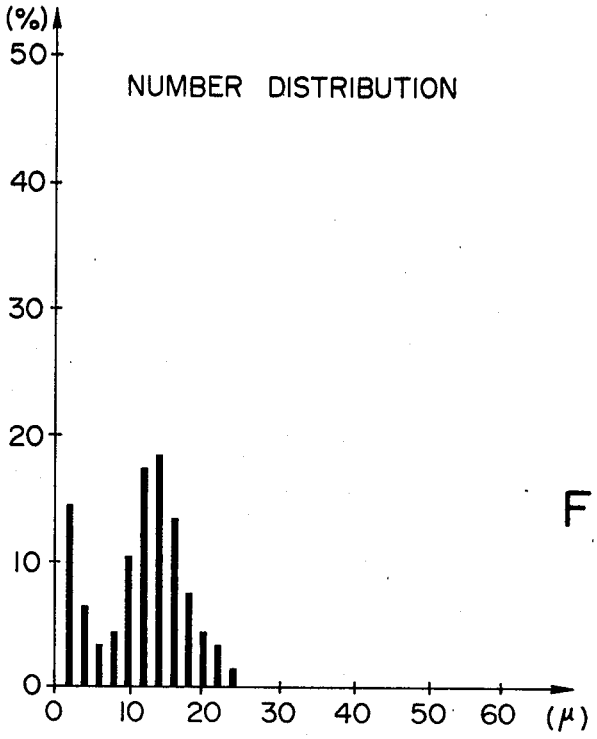
FIGS. 1A and 1B are graphs illustrating the particle member distribution for the particle diameter of developer particles and the weight distribution for the particle diameter, respectively.

Before specific embodiments of the present invention are described, the problem mentioned under item (2) above, namely, the contamination of the surface of the developer holding means by developer, will be further discussed to make clear the objects, operation and effect of the present invention.

As already described, in a long time during which the developing action is carried out, a thin layer of developer may be formed on the surface of the developer holding means to reduce the developing performance.

During the developing action, the developer always repeates contact with and separation from the surface of the developer holding means and therefore, the surface of the developer holding means is contaminated by the developer and a film layer of developer is liable to form on that surface. This film layer consists of resin component of low molecular weight contained in the developer, or a control agent for providing, friction, or a layer of very fine powder which does not contribute to development. More particularly, the following chemicals are generally often used as said control agent: Spyron Blue GNH (produced by Hodogaya Kagaku, Co., Ltd., C.I. Solvent Blue 67), Zabbon Fast Brack B (produced by BASF, C.I. 12195) Oil Blue #15 (produced by Yamamoto Kagaku Co., Ltd., C.I. 74350, C.I. Solvent Blue 25), McRolex Blue (produced by Baiel Co., C.I. Solvent Blue 97), Barifast Blue 2606 (produced by Orient Kagaku Co., Ltd., oil color), Oil Blue BOS (produced by Orient Kagaku Co., Ltd., oil color, C.I. 74350), Cassette Yellow G (produced by Nippon Kayaku Co., Ltd., C.I. 11855, C.I. Solvent Yellow 77), Eisensypronred BEH (produced by Hodogaya Kagaku Co., Ltd., C.I. Solvent Red 83), Celitonred SF7874 (produced by BASF, dispersed dyes), and Cassette Yellow 963 (produced by Nippon Kayaku Co., LTD., dispersed dyes). Also, the main component of said fine powder which does not contribute to development but adheres to the surface of the developer holding means for forms a thin layer thereon is the resin component contained in the developer and more particularly, it includes the following: styrene and monopolymers of substitution produces thereof such as polystyrene, poly-p-chlorostyrene and polyvinyl toluene, styrene copolymers such as styrene-p-chlorostyrene copolymer, styrene-vinyl toluene copolymer, styrene-vinyl naphthalene copolymer, styrene-acrylic acid methyl copolymer, styrene-acrylic acid ethyl copolymer, styrene-acrylic acid butyl copolymer, styrene-acrylic acid octyl copolymer, styrene-meta-acrylic acid methyl copolymer, styrene-meta-acrylic acid ethyl copolymer, styrene-meta-acrylic acid butyl copolymer, styrene-α-chlorometa-acrylic acid methyl copolymer, styrene-acrylonitrile copolymer, styrene-vinyl methyl ether copolymer, styrene-vinyl ether copolymer, styrene vinyl methyl ketone copolymer, styrene-butadiene copolymer, styrene-isoprene copolymer and styrene-acrylonitrile-indene copolymer, polyvinyl chloride, polyvinyl acetate, polyethylene, polypropylene, silicone resin, polyester, polyurethane, polyamide, epoxy resin, polyvinyl butyral, rosin, denatured rosin, terpene resin, phenol resin, fatty hydrocarbon resin, aromatic petroleum resin, chlorinated paraffin and paraffin wax. Further, the material which aheres to the surface of the developer holding means may sometimes be the extraneously added fine particles of the so-called one-component developer which consists of toner particles and hydrophobic silica having a particle diameter smaller than that of said toner particles and extraneously added to said toner particles and which does not contain carrier particles greater in particle diameter than the toner particles.

Figure 1B:
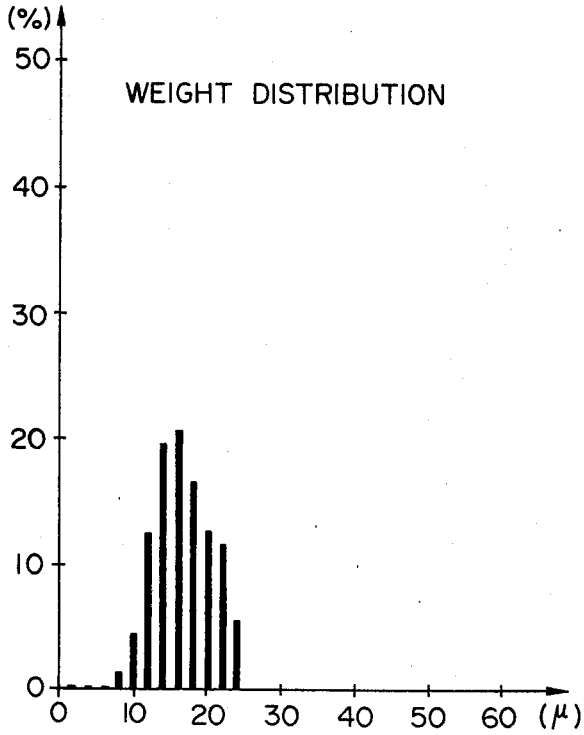

The fine particles containing much resin which do not contribute to development but adhere to the surface of the developer holding means to form a thin layer can be produced as by mixing resin with magnetic powder, charge control agent, carbon, etc., melting the mixture in a roll mill, cooling the same, roughly powdering the same by the use of a hammer mill, and then finely powdering the same into developer by the use of an ultrasonic jet powdering machine. The particle diameter destribution of the developer particles produced by the fine powdering contains considerably many fine particles. Therefore, rough particles are removed therefrom by the use of a classifier and these fine particles are also removed. However, fine particles having a low content of magnetic powder cannot yet be removed completely. An example of the particle diameter distribution of the developer particles after the classification is shown in FIGS. 1A and 1B. FIG. 1A shows the particle number distribution for the particle diameter, and FIG. 1B shows the weight distribution for the particle diameter. As shown in these Figures, considerably many fine particles which are light in weight (low in magnetic powder content) are still present even after the classification. These fine particles low in magnetic powder content or free of magnetic powder (they consist of only resin when observed through a microscope), once they electrostatically strongly adhere to the developer holding means, are not moved even by magnetic force because the magnetic force received by these particles is weak, so that a thin layer of these fine particles is formed on the surface of the developer holding means. When the surface of the developer holding means is thus covered with such fine particles, the frictional charge between the surface of the developer holding means and the developer is so affected that the developer cannot be friction-charged to a normal value and the amount of charge of the developer becomes deficient and in addition, where the application of the developer onto the developer holding means depends on the electrostatic force between the developer holding means and the developer, it becomes difficult for the developer to be applied onto the developer holding means and this leads to occurrence of the problem that the developing density is reduced or the image reproduciblility is aggravated.

The present invention above solves such a problem and embodiments thereof will hereinafter be described.

Figure 2:
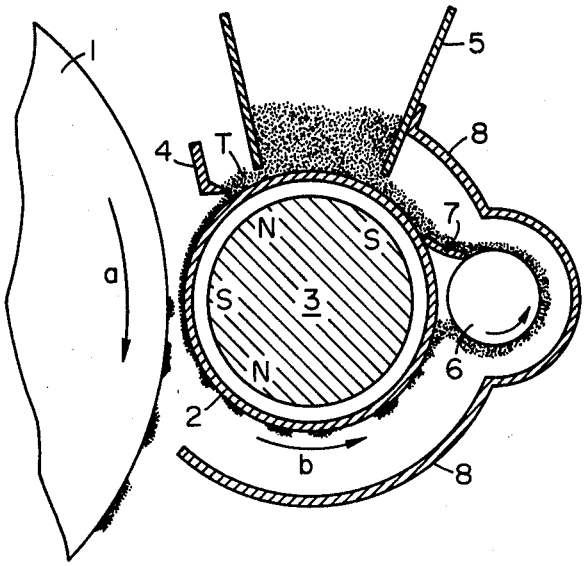
FIG. 2 is a cross-sectional view illustrating the construction of an embodiment of the developing device according to the present invention.

FIG. 2 shows an embodiment of the present invention. Designated by 1 in FIG. 2 is an electrostatic latent image bearing member such as a photosensitive medium or an insulative medium on which an electrostatic latent image has been formed. It is movable in the direction of arrow a. Reference numeral 2 designates a non-magnetic developing sleeve (formed of, for example, stainless metal, brass, plastics, rubber or the like) disposed with a minute gap with respect to the electrostatic latent image bearing member. The sleeve 2 is rotatable in the direction of arrow b. This minute gap is set to a gap greater than the thickness of the developer layer formed on the sleeve as the developer holding means. Within the developing sleeve 2, a magnetic roll 3 magnetized as shown is fixedly provided. By the magnetic force of this magnetic roll, a layer of developer T is formed on the surface of the developing sleeve. The layer of developer has its thickness controlled by a doctor blade 4 (formed of iron, for example) disposed in proximity to the surface of the developing sleeve. The spacing between the tip end of this doctor blade and the developing sleeve is set to 200 μm, for example.

To make the thickness control of the developer layer more accurate and positive, a magnetic pole is disposed inside the developing sleeve at a portion thereof opposed to the tip end of the blade. The developer layer whose thickness has been controlled then reaches the developing position opposed to the electrostatic latent image bearing member and effects development by any one of the aforementioned developing methods. After the termination of the development, the thickness of the developer layer has already been varied in accordance with the electrostatic latent image in such a manner that the portion thereof which has corresponded to the image bearing portion becomes thinner, the portion thereof which has corresponded to the non-image bearing portion maintains its original thickness and the portion thereof which has corresponded to the half-tone portion is changed to a thickness corresponding to the electrostatic latent image potential.

On the surface of the developing sleeve after the termination of the development, not only the layer thickness has been varied as already described, but also the characteristic of the developer has been varied. Accordingly, in this embodiment, a developer removing roller 6 to which a voltage opposite in polarity to the developer has been applied is disposed in proximity to the surface of the developing sleeve at a position upstream of a hopper 5 so as to electrostatically attract and remove the developer on the developing sleeve after the termination of the development. The developer on the developer removing roller 6 is collected onto the surface of the developing sleeve by a collecting blade 7. Designated by 8 is a cover for preventing the scattering of the developer.

By the developer removing roller 6 being thus provided at the position upstream of the hopper 5, it is possible to make the surface of the developing sleeve always clean and then apply the developer thereonto and thus it is possible to solve all the aforementioned problems and ensure a stable developing performance to be maintained.

Figure 3:
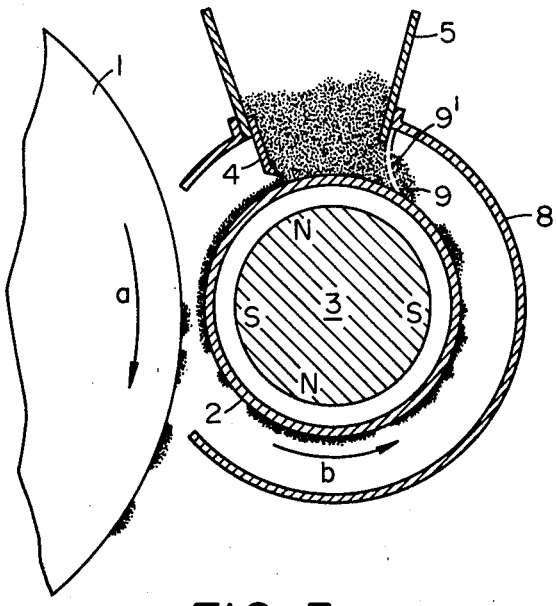
FIGS. 3 and 4 are cross-sectional views showing further embodiments of the present invention.

FIG. 3 shows another embodiment of the present invention. The members designated by reference characters similar to those in FIG. 2 have similar functions, but this embodiment differs from the embodiment of FIG. 2 in that the doctor blade for controlling the thickness of the developer layer is attached to the hopper. In the embodiment of FIG. 3, the construction for removing the developer on the developing sleeve is as follows. Immediately before the developer is supplied by the hopper, the developer on the surface of the developing sleeve is once scraped off by a developer removing plate disposed in contact with the surface of the developing sleeve. That is, a developer removing plate 9 is attached to the end of the upstream wall 7 of the hopper 5 with respect to the direction of movement of the developer layer on the developing sleeve 2 in such a manner that the developer removing plate is in contact with the surface of the developing sleeve. The angle of attachment thereof may preferably be an angle in the counter direction with respect to the direction of movement of the developer layer so that the developer may be scraped up. This removing plate may be formed of phosphor bronze having a thickness of about 100 μm, for example, and may preferably be one which is urged against the surface of the developing sleeve by sufficiently utilizing the resiliency thereof so that the bend length of the removing plate when brought into contact is about 10 mm for the length 20 mm of the removing plate.

A number of apertures 9′ are provided in the neighborhood of that portion of the removing plate which is in contact with the developing sleeve, so that the removed developer is directed through these apertures into the hopper 5 for collection and reuse.

In the above-described construction, the developing sleeve is rotated in the direction of arrow b, whereby the developer in the hopper is moved in the direction of arrow to form a layer of developer on the surface of the developing sleeve and is uniformly applied to the thickness of about 80 μm by the doctor blade 4. After the uniform application of the developer, the developer layer becomes opposed to the photosensitive medium 1 having an electrostatic latent image formed thereon, by further rotation of the developing sleeve, to thereby develop the latent image. After the termination of the development, the developer layer is scraped off from the surface of the developing sleeve by the developer removing plate 9 attached to the wall of the hopper and the scraped-off developer passes into the hopper through the apertures 9′ provided in the neighborhood of that portion of the removing plate which is in contact with the developing sleeve.

Figure 4:
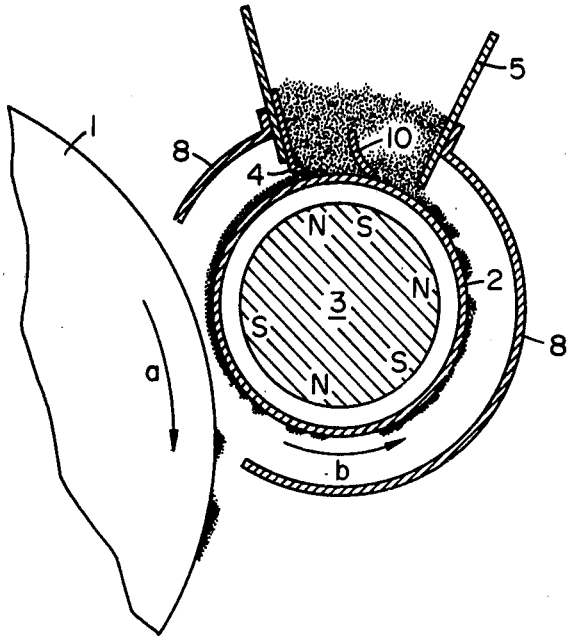

FIG. 4 shows a further embodiment of the present invention. Again in FIG. 4, those members designated by reference characters similar to those in FIGS. 2 and 3 have similar functions. In FIG. 4, as the construction for removing the developer on the developing sleeve, a developer removing plate urged against the surface of the developing sleeve is disposed within the hopper 5 so as to once remove the developer from the surface of the developing sleeve within the hopper. By this, the aforementioned problems are all solved.

Figure 5:
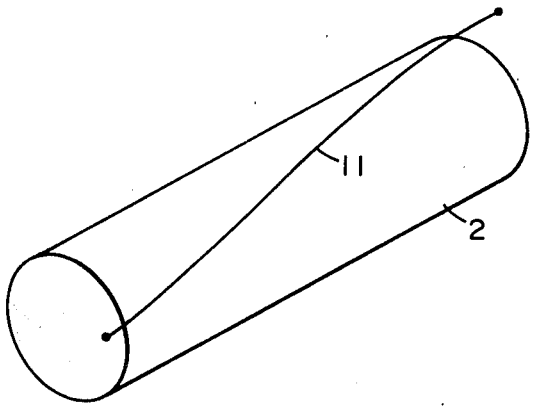
FIG. 5 is a perspective view showing another embodiment of developer removing means.

In the embodiments of FIGS. 3 and 4, when the removing plate was absent, the developing reflection density was reduced from 1.2 to 0.5 after about one-hour use, but when use was made of the method of cleaning the surface of the developing sleeve by the removing plate, the developing density remained unchanged, maintaining 1.2. In this case, the ability to prevent the deterioration of the image by providing the removing plate was attributable to the ability to remove, by the removing plate, fine powder which could not be removed during the developer manufacturing step and which strongly adhered to the surface of the developing sleeve and silicon dioxide which was added to the developer for the purpose of improving the charging characteristic and fluidity of the developer and which also strongly adhered to the developing sleeve. In addition, there was also obtained a great effect for the case where a certain component of the developer adhered to the surface of the developing sleeve to prevent sufficient contact between the developer and the developing sleeve and the developer could not provide a sufficient toriboelectrical charging effect. Also, a similar effect could be obtained by bringing a thin metal wire 11 into contact with the entire lengthwise dimension of the surface of the developing sleeve 2 at an angle with respect to the axis of the sleeve, as shown in FIG. 5. In this case where a copper wire having a diameter of 0.2 mm was obliquely stretched on a sleeve having an outside diameter of 30 mm and a length of 350 mm (if the angle formed by the wire with the axis of the sleeve is $\theta$, $\tan\theta \approx (1/70)$ to clean the sleeve surface, the tension of the metal wire had to be 1 Kg or more. When the tension was substantially more than this value, the aforementioned substances liable to adhere to the sleeve surface could be removed.

Figure 6A:
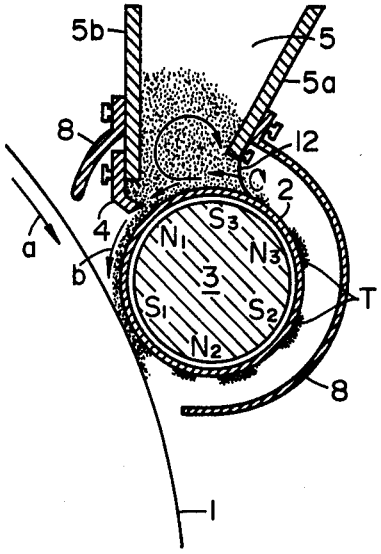
FIG. 6A is a cross-sectional view illustrating the construction of still another embodiment of the developing device according to the present invention.

FIG. 6A shows still another embodiment of the present invention. In FIG. 6A, reference character 1 designates an electrostatic latent image bearing member such as a photosensitive medium or an insulative medium having an electrostatic latent image formed thereon. It is movable in the direction of arrow a. Designated by 2 is a non-magnetic developing sleeve (formed of, for example, stainless metal or brass) disposed with a minute gap with respect to the electrostatic latent image bearing member. The sleeve 2 is rotatable in the direction of arrow b. This minute gap is set to a gap greater than the thickness of the thin developer layer formed on the developing sleeve. Within the developing sleeve, a magnetic roll 3 magnetized as shown in fixedly provided. By the magnetic force of this magnetic roll, a layer of developer T is formed on the surface of the developing sleeve. The layer of developer has its thickness controlled by a doctor blade 4 (formed of iron, for example) disposed in proximity to the surface of the developing sleeve. The spacing between the tip end of this doctor blade and the developing sleeve is set to 200 μm, for example. To make the thickness control of the developer layer more accurate and positive, a magnetic pole is disposed inside the developing sleeve at a portion thereof opposed to the tip end of the blade. The developer layer whose thickness has been controlled then reaches the developing position opposed to the electrostatic latent image bearing member and effects development by any one of the previously described developing methods. After the termination of the development, the thickness of the developer layer has already been varied in accordance with the electrostatic latent image in such a manner that the portion thereof which has corresponded to the image bearing portion becomes thinner, the portion thereof which has corresponded to the non-image bearing portion maintains its original thickness and the portion thereof which has corresponded to the half-tone portion is changed to a thickness corresponding to the electrostatic latent image potential.

Figure 6B:
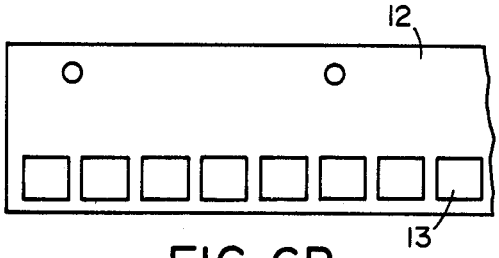
FIG. 6B is a front view of the developer removing plate thereof.

On the surface of the developing sleeve after the termination of the development, the layer thickness has been varied as already described and the characteristic of the developer has also been varied and therefore, design is made such that, immediately before developer is supplied by a hopper 5, the developer is once scraped off by a developer removing plate disposed in contact with the surface of the developing sleeve. That is, a developer removing plate 12 is attached to the end of the upstream wall 5*a* of the hopper 5 with respect to the direction of movement of the developer layer on the developing sleeve 2 in such a manner that the developer removing plate contacts the surface of the developing sleeve. The angle of attachment thereof may preferably be an angle in the counter direction with respect to the direction of movement of the developer layer as shown so that the developer may be scraped up. This removing plate may preferably be formed of, for example, phosphor bronze having a thickness of about 130 μm. This removing plate may also be provided by an extension of the hopper wall 5*a*, but again in such case, the removing plate may preferably be a resilient member so that it may uniformly contact the developing sleeve. A number of apertures 13 are provided in the neighborhood of that portion of the removing plate 12 which is in contact with the developing sleeve, as shown in FIG. 6B. The shape of these apertures may preferably be, for example, a square having sides of 10 mm each.

In the above-described construction, the developing sleeve is rotated in the direction of arrow b, whereby the developer within the hopper is moved as indicated by arrow to form a layer of developer on the surface of the developing sleeve and the layer is uniformly applied to a thickness of about 80 μm by the doctor blade 4. After the uniform application of the developer layer, the developer layer becomes opposed to the photosensitive medium 1 having an electrostatic latent image formed thereon by further rotation of the developing sleeve, thus developing the latent image. After the termination of the development, the developer layer is scraped off from the surface of the developing sleeve by the developer removing plate 12 attached to the wall 5*a* of the hopper, and the developer so scraped off passes into the hopper through the apertures 13 provided in the neighborhood of the portion of the removing plate which is in contact with the developing sleeve. In this case, if the fluidity of the magnetic developer T is high, the developer passes into the hopper 5 through the apertures 13 in the developer removing plate 12, but if the fluidity of the magnetic developer T is low, it becomes difficult for the developer to stably pass through these apertures 13. It is therefore necessary to generate a magnetic field which will attract the magnetic developer near the apertures 13 toward the interior of the hopper 5. That is, if a magnetic pole $S_3$ is disposed inside the developing sleeve 2 at a portion thereof opposed to these apertures 13 as shown in FIG. 6A, the magnetic developer scraped off by the developer removing plate 12 can easily pass through the apertures 13 into the hopper 5. The intensity of this magnetic pole $S_3$ may preferably be of the order of 450 to 850 gausses on the developing sleeve 2, and a greater intensity of the magnetic field has ensured greater stability with which the developer passes through the apertures 13 into the hopper. The developer scraping action of the developer removing plate and the action of introducing the developer into the hopper have been carried out satisfactorily without the developer accumulating on the tip end of the removing plate even if the developing sleeve has been continuously rotated. A member 8 provided upstream and downstream of the hopper is a cover for preventing the scattering of the developer.

By so providing the developer removing plate before developer is newly supplied after the termination of the development, it is possible to make the surface of the developing sleeve always clean and then effect the application of developer and this leads to the ability to maintain a stable developing performance without the fusion of the developer onto the surface of the developing sleeve.

Figure 7:
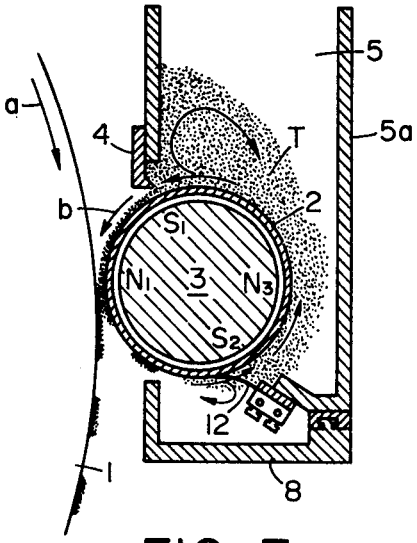
FIGS. 7 and 8 are cross-sectional views showing further embodiments of the present invention.

FIG. 7 shows still a further embodiment of the present invention. This embodiment is generally identical in construction to the embodiment of FIG. 6A, with the exception that a developer removing plate 12 is provided below the developing sleeve. In this case, to prevent the scraped-off developer from falling downwardly, a magnetic pole $S_2$ is disposed inside the developing sleeve at a portion thereof opposed to the apertures provided in the removing plate. By attaching this removing plate to the wall 5*a* of the hopper 5, the developer in the hopper is prevented from dropping. Designated by 8 is a cover for preventing the scattering of the developer and this is particularly effective where the scattering of the developer occurs near the removing plate 12. The cover 8 serves also as a receptacle for receiving the developer dripping from the hopper and is removably mounted to the hopper by means of a rail. The movement of the developer is generally the same as that in the embodiment of FIG. 6A, but the developer removed by the removing plate is collected into the hopper through the apertures 13 in the removing plate and is sufficiently stirred for mixing with the developer in the hopper, whereafter a layer of developer is newly formed on the developing sleeve so that it may be used for development.

Figure 8:
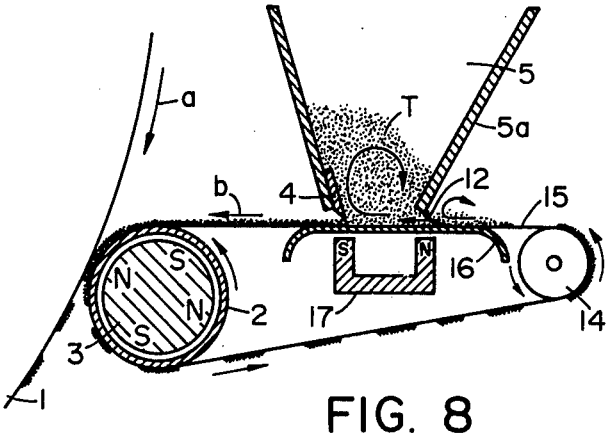

FIG. 8 shows still another embodiment of the present invention. In this embodiment, as the developer holding means a belt 15 is used instead of a developing sleeve and developer is applied onto this belt, which is moved round to effect development. Development is effected with the belt 15, having magnetic developer applied thereto, being opposed to an electrostatic latent image bearing member 1. Designated by 2 is a sleeve having a magnet roll 3 therewithin and driving the belt 15. Denoted by 14 is a rotatable roller. The belt 15 is passed over the sleeve 2 and the roller 14 and is moved round. Designated by 16 is a back side supporting member of non-magnetic material for positioning the belt 15 in place. Denoted by 4 is a doctor blade for controlling the thickness of the magnetic developer layer on the belt 15. One of the poles of a magnet 17 is disposed adjacent to that portion of the back side of the belt 15 which is opposed to the tip end of the doctor blade, to thereby ensure the accuracy with which the thickness of the developer layer is controlled. A developer removing plate (a phosphor bronze plate) 12 having apertures at the end thereof is attached to the wall 5*a* of a hopper 5 which is a device for supplying magnetic developer T, and the end of the developer removing plate is in contact with the belt 15. The end of the phosphor bronze plate 12 is in contact with the belt 15 in such a manner that said end is opposed to the direction in which the developer on the belt comes back, and the other pole of the magnet is disposed adjacent to that portion of the back side of the belt 15 which is opposed to the apertures formed at the end of the removing plate 12. The magnet may be a permanent magnet or an electromagnet and the magnetic field reaching the apertures at the end of the removing plate 12 may be an alternating magnetic field (this also holds true with all the above-described embodiments). In the present embodiment, there is not provided a cover for preventing the scattering of the developer which may occur at the end of the removing plate, but such cover may be provided as required. The developer scraped off by the end of the removing plate 12 slightly accumulates on the portion of contact with the developing sleeve, whereafter such developer passes through the apertures (see FIG. 6B) provided at the end of the removing plate 12 and into the hopper 5 to assume a substantially steady state.

As the result of such construction and operation, the history of development of the developer layer on the developer holding means is erased and therefore, no ghost is created during the next cycle of development and in addition, even if the developing action is effected for a long time, no thin layer of developer is formed on the surface of the developer holding means, so that the friction charge effect is well maintained to ensure a good developing performance to be maintained. Further, the developer layer used for development is once removed and a fresh developer layer is newly formed and thus, no aggregation of the developer occurs. Furthermore, there is obtained a remarkable effect that the materials of the developer may be selected by paying attention only to the initial developing and fixing performances and so, the range of selection of the materials can be widened. Another great effect of the present invention is that the developer on the surface of the developer imparting means is always replaced by fresh developer and so, irregularity of the developer layer on the surface of the developer imparting means does not occur which is liable to occur when a developer having a high aggregating force is used. If the developer which has not contributed to development remains immovable on the developer imparting means for a long time, the aggregating force of the developer or the adhering force between the developer and the imparting means is increased and the thickness of the developer layer tends to increase, thus making stable image reproducibility difficult to obtain. However, this problem can be solved by giving movement to the developer on the imparting means as in the present invention. The cleaning step for the developer imparting means of the present invention becomes necessary for the purposes of stably supplying the charge amount of the developer as described above and avoiding the aggregation of the developer, whereas the cleaning step need not always be carried out for the developer imparting means at all times, but a considerably high effect can be achieved, for example, by carrying out one cleaning step after the termination of one hundred developing steps. If the cleaning step is adopted, the device tends to become complicated in respect of the re-use of the removed developer and for example, in the device having the removing plate disposed in the hopper, the removing plate may be intermittently brought into contact with and separated from the imparting means to thereby make the developer accumulated on the front face of the removing plate readily available for re-use.

Common effects in the above-described embodiments are as follows:

(a) Ease with which the removing plate such as scraper is replaced by a new one;

(b) Ease with which undesirable admixture such as paper powder is removed;

(c) Possibility of easily returning the once removed toner to the hopper for re-use by providing openings in the removing plate such as scraper; and (d) Ease with which the developer scatter preventing plate is replaced by a new one.

What has been referred to as the one-component developing method in the foregoing description is so referred to for the mixed system of carrier particles and toner particles, and the mixture of toner particles and a charge control agent, a lubricant, an abrasive or the like is within the range of one-component development. In the foregoing embodiments, the latent image bearing member has been described with respect to an electrostatic latent image, but it is also applicable to magnetic latent images. In this latter case, magnetic field generating means which will disturb the magnetic latent image must not be disposed within the magnetic sleeve opposed to the magnetic latent image. Further, in the foregoing embodiments, the magnetic roll has been described as fixed and the developing sleeve has been described as movable, but the magnetic roll may be movable and the developing sleeve may be fixed and other various relative movements are applicable. Also, the developer holding means has been described with respect to a non-magnetic developing sleeve, but is may also be in the form of a belt.

What we claim is:

1. A developing device comprising:

developer holding means disposed with a gap with respect to a latent image bearing member for holding and moving developer to a development station;

developer supply means for supplying developer to the surface of said developer holding means; and a developer removing blade adapted to be in contact with the surface of said developer holding means to remove the developer on the surface of said developer holding means, said developer removing blade having developer passage openings adjacent to the portion thereof which is in contact with the surface of said developer holding means thereby again imparting the removed developer to the surface of said developer holding means at a position which is downstream of said development station with respect to the movement of the developer and which is before the supply of developer is terminated at the developer supply means.

2. The developing device according to claim 1, wherein said developer removing blade is at a position for removing any developer remaining on the surface of said developer holding means prior to the supply of developer by said developer supply means.

3. The developing device according to claim 1, wherein said developer removing blade is attached to a wall of said developer supply means.

4. The developing device according to claim 1, wherein said developer removing blade is provided within said developer supply means.

5. The developing device according to claim 1, wherein the end edge of said developer removing blade is in resilient contact with the surface of said developer holding means.

6. A developing device comprising:

endless developer holding means, disposed with a gap with respect to a latent image bearing member, for holding and moving developer in a predetermined direction to a development station;

developer supply means for supplying magnetic developer to the surface of said developer holding means; and a developer removing blade adapted to be in contact with the surface of said developer holding means to remove the developer on the surface of said developer holding means, said developer removing blade having developer passage openings adjacent to the portion thereof which is in contact with the surface of said developer holding means thereby again imparting the removed developer to the surface of said developer holding means at a position which is downstream of said development station with respect to the movement of the developer and which is before the supply of developer is terminated at the developer supply means.

7. The developing device according to claim 6, further comprising means for controlling the thickness of the developer on said developer holding means, wherein said endless developer holding means has a fixed magnet roll and a relatively movable non-magnetic sleeve enclosing said roll, and said magnet roll has at least magnetic poles at a said development station and a position opposed to said developer layer thickness controlling means.

8. The developing device according to claim 7, wherein said developer layer thickness controlling means is in the form of a magnetic blade and the magnetic pole opposed to said controlling means is stationary.

9. The developing device according to claim 6, wherein said developer supply means is a hopper containing one-component magnetic toner therein.

10. The developing device according to claim 6, wherein said developer supply means has attached thereto a scatter preventing cover for preventing developer scattering and covering the other portion of the surface of said developer holding means than at the development station.

11. The developing device according to claim 6, wherein said endless developer holding means is an endless belt.

12. The developing device according to claim 6, wherein said developer removing blade is attached to extend in the opposite direction with respect to the direction of movement of the developer layer on said developer holding means.

13. A developing device comprising:

endless developer holding means disposed with a gap with respect to a latent image bearing member for holding and moving developer to a development station;

developer supply means for supplying developer to the surface of said developer holding means;

a developer removing blade adapted to be in contact with the surface of said developer holding means to remove the developer on the surface of said developer holding means, said developer removing blade having developer passage openings adjacent to the portion thereof which is in contact with the surface of said developer holding means thereby again imparting the removed developer to the surface of said developer holding means at a position which is downstream of said development station with respect to the movement of the developer and which is before the supply of developer is terminated at the developer supply means; and a magnetic field generating portion provided at the portion of said developer holding means which is adjacent to said developer passage openings.

14. A device in which triboelectrical charge is imparted to a developer and the developer is provided on the surface to be developed to thereby effect development, said device comprising a developer holding member disposed with a gap with respect to a latent image bearing member, a doctor blade for controlling the thickness of a developer layer on said holding member, and a blade having developer passage openings disposed at a suitable position between the exit end of a developing station and the exit end of a developing supply station for removing the developer which remains on said developer holding member after development and again imparting the removed developer to the surface of said developer holding member, whereby development may be effected with developer supplied for each cycle of development.

15. A device in which triboelectrical charge is imparted to developer by the friction between the developer and its carrying means and the developer is used for development, said device comprising:

a station for supplying the developer to the developer carrying means in each cycle of development;

a station for imparting the developer to a surface to be developed to thereby develop said surface; and a station disposed at a predetermined position between the exit end of the developing station and the exit end of the supply station for removing, with a developer removing member having developer passage openings, from said developer carrying means substantially all of the developer remaining after having passed through said developing station and again imparting the removed developer to said developer carrying means.

* * * * *